US006200446B1

(12) United States Patent
Inoue et al.

(10) Patent No.: US 6,200,446 B1
(45) **Date of Patent: *Mar. 13, 2001**

(54) ELECTROPHORETIC COLORING COMPOSITION

(75) Inventors: Hiroshi Inoue; Shigeyasu Inoue, both of Osaka; Seishiro Ito, Ikoma, all of (JP)

(73) Assignee: Sakura Color Products Corporation, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/776,663

(22) PCT Filed: May 27, 1996

(86) PCT No.: PCT/JP96/01451

§ 371 Date: Jan. 30, 1997

§ 102(e) Date: Jan. 30, 1997

(87) PCT Pub. No.: WO96/38604

PCT Pub. Date: Dec. 5, 1996

(30) Foreign Application Priority Data

May 30, 1995 (JP) ..... 7-157213

(51) Int. Cl.[7] ..... C25D 13/00

(52) U.S. Cl. ..... 204/486; 204/496; 204/497; 204/508; 106/499; 428/457

(58) Field of Search ..... 204/486, 496, 204/497, 508; 106/499; 428/457

(56) References Cited

U.S. PATENT DOCUMENTS

| | | | | |
|---|---|---|---|---|
| 3,963,568 | * | 6/1976 | Nikaido et al. | 204/181 |
| 4,312,730 | * | 1/1982 | Bartz | 204/496 |
| 4,460,727 | * | 7/1984 | Shoji | 524/215 |
| 5,098,478 | * | 3/1992 | Krishnan et al. | 106/23 |
| 5,106,417 | * | 4/1992 | Hauser et al. | 106/20 |
| 5,334,297 | * | 8/1994 | Nakada et al. | 204/181.2 |
| 5,492,614 | * | 2/1996 | Zawacky et al. | 1/9 |
| 5,585,189 | * | 12/1996 | Inoue et al. | 428/461 |

OTHER PUBLICATIONS

CA:1994: 6355,898 (No Month Available, 1994.*

* cited by examiner

*Primary Examiner*—Kishor Mayekar
(74) *Attorney, Agent, or Firm*—Armstrong, Westerman, Hattori, McLeland & Naughton

(57) ABSTRACT

A pigment dispersion composition for fill-in coloration of an aluminum or aluminum alloy oxide film is provided, which comprises at least a pigment, a pigment dispersant, a water-soluble organic solvent, water, and a water-soluble amine and/or a derivative thereof. Pigment particles of the pigment dispersion composition are filled in micropores of the aluminum oxide film to a great depth, so that a vivid color film having excellent weatherability and fastness can be provided. In addition, the composition offers a high adaptability for repetitive coloration, and allows pigment deposited on the film surface other than in the micropores to be washed away by simple immersion in still water or running water.

30 Claims, No Drawings

ELECTROPHORETIC COLORING COMPOSITION

This application is a 35 U.S.C. 371 National Stage of PCT/JP 96/01451, filed May 27, 1996.

TECHNICAL FIELD

The present invention relates to a pigment dispersion composition for fill-in coloration of an aluminum or aluminum alloy oxide film, which is adapted to fill micropores of the aluminum or aluminum alloy oxide film with a pigment for coloration thereof.

BACKGROUND ART

In an attempt to provide a colored film of high practicality, the inventor of the present invention has previously proposed a pigment dispersion composition for fill-in coloration of an aluminum or aluminum alloy oxide film, the pigment dispersion composition being adapted to fill micropores of the oxide film with a pigment by electrophoresis for coloration thereof, wherein a 50%-cumulative point (average particle diameter: D50) of the pigment particle diameter distribution in the dispersion is 200 nm or smaller. This pigment dispersion composition provides for a vivid color film having excellent weatherability and fastness and enables repetitive coloration because pigment particles are filled in the micropores of the aluminum oxide film to a great depth.

In actual use, however, the pigment is unavoidably deposited on the film surface as well as in the micropores when the electrophoresis is performed to fill the pigment into the micropores. The pigment deposited on the film surface other than in the micropores is likely to lead to an unstable color density of a thus colored material and to be brought into an electrodeposition surface coating bath in the succeeding step to contaminate the bath. With an anodic aluminum oxide film having micropores of diameters of about 50 nm or smaller, in particular, this tendency becomes more remarkable since most of the pigment is deposited on the film surface other than in the micropores, though depending on the size of the pigment particles. Even with an anodic aluminum oxide film having micropores of diameters of greater than 50 nm, the pigment is unavoidably deposited on the film surface as well as in the micropores, as stated above.

Thus, it has been required to wash away the pigment deposited on the film surface other than in the micropores irrespective of the micropore diameter of the anodic aluminum oxide film for convenience in the operational procedure in order to prevent such disadvantages. Typical means for washing away the pigment deposited on the film surface other than in the micropores are brushing, showering and like means which require cumbersome operations with time and labor. Therefore, the deposited pigment is preferably removed by simple immersion in still water or running water.

It is an object of the present invention to provide a pigment dispersion composition for fill-in coloration of an aluminum or aluminum alloy oxide film, which is adapted to fill pigment particles into micropores of the film to a great depth to provide for a vivid color film having excellent weatherability and fastness and allows repetitive coloration, and which permits the pigment deposited on the film surface other than in the micropores to be readily washed away by simple immersion in still water or running water.

DISCLOSURE OF THE INVENTION

As a result of intensive study to attain the above object, a pigment dispersion composition has been realized which, after having been applied onto an anodic aluminum oxide film for fill-in coloration, permits the pigment thereof deposited on the surface other than in micropores of the film to be advantageously removed by simple immersion in still water or running water, thereby allowing easy cleaning.

More specifically, it has been discovered that, if a pigment dispersion composition for fill-in coloration of an aluminum or aluminum alloy oxide film contains at least one compound selected from the group consisting of water-soluble amines and/or derivatives thereof, certain water-insoluble amines and/or derivatives thereof, water-soluble polyvalent alcohols, and water-soluble urea and thiourea and derivatives thereof, such compounds act to reduce the drying speed of water contained in the pigment dispersion composition. This is conceivably because such a compound dissolves in water and chemically associates with dispersed pigment or dispersant existing around the surface of each pigment particle. Further, even after the composition is dried, the pigment deposited on the surface of the aluminum film can readily be removed by simple water washing probably because the compound remains as intervening between pigment particles or between the pigment particles and the film surface. It has also been discovered that the pigment dispersion composition for fill-in coloration containing any of the foregoing compounds permits the pigment particles to be filled into micropores of the aluminum film to a great depth thereby providing for a vivid color film having excellent weatherability and fastness and, in addition, enables repetitive coloration.

The present invention provides a pigment dispersion composition for fill-in coloration of an aluminum or aluminum alloy oxide film, essentially consisting of a pigment, a pigment dispersant, a water-soluble organic solvent, water, and a water-soluble amine and/or a derivative thereof.

Examples of specific water-soluble amines and/or derivatives thereof include mono-, di- and trialkanolamines such as methanolamine and ethanolamine, and derivatives thereof. Such water-soluble amines and/or derivatives thereof are desirably those having a solubility of 1 g or greater in 100 g of water at 25° C., for example, triethanolamine (pKa at 25° C.=7.76).

The present invention also provides a pigment dispersion composition for fill-in coloration of an aluminum or aluminum alloy oxide film, essentially consisting of a pigment, a pigment dispersant, a water-soluble organic solvent, water, and a water-insoluble amine and/or a derivative thereof.

When such a water-insoluble amine and/or a derivative thereof is used, it is desired that the pigment dispersant comprise a resin acid and that the water-insoluble amine and/or derivative thereof has a pKa value between 7.1 and 12 at 25° C., the pKa value being defined as the logarithm of the reciprocal of the acid dissociation constant of a conjugate acid from the resin acid. Examples of preferred water-insoluble amines and/or derivatives thereof include mono-, di- and trialkylamines such as methylamine and ethylamine; aromatic amines such as benzylamine, and derivatives thereof; heterocyclic amines such as piperidine, piperazine and morpholine, and derivatives thereof. Such a water-insoluble amine and/or derivative thereof is used as a neutralizer for the resin acid, thereby being turned into a compound which can be homogeneously contained in water.

A compound having a pKa value of greater than 12 such as guanidine exhibits a too strong alkalinity and, hence, will provide a dispersion exhibiting an undesirably strong alkalinity, so that a coloring failure and corrosion of an aluminum plate will result. On the other hand, a compound having a pKa value of smaller than 7.1 such as pyridine or o- or p-nitroaniline exhibits a too weak alkalinity and, hence, cannot cause the resin to dissolve, resulting in an undesirable pigment dispersion. In this connection, a compound having a pKa value ranging from 7.1 to 12 is preferable such as methylamine (pKa at 25° C.=10.6), piperidine (pKa at 25° C.=11.1) or triethylamine (pKa at 25° C.=10.7). In particular, methylamine (pKa at 25° C.=10.6) and triethylamine (pKa at 25° C.=10.7) having a pKa value within a range between 7.5 and 11 are best-suited for the purpose of the invention.

It should herein be noted that, although an expression generally applied to the dissociation of a weak base represents a pH value in relation to a pKb value, the present invention uses a pKa value. The expression representing a pH value in relation to a pKb value is transformed into an expression simply representing the pH value in relation to a pKa value as follows.

$$pH=14-(½)pKb+(½)\log C \quad (1)$$

where C represents an electrolyte concentration, $$Ka \times Kb = Kw \quad (2)$$

where Kw represents the ionic product of water, $$-\log Ka - \log Kb = -\log Kw \quad (3)$$

wherein −log Kw=14 and −log K=pKw, $$pKb = 14 - pKa \quad (4)$$

which is substituted into the expression (1) to provide:

$$pH=7+(½)pKa+(½)\log C$$

The present invention yet provides a pigment dispersion composition for fill-in coloration of an aluminum or aluminum alloy oxide film, essentially consisting of a pigment, a pigment dispersant, a water-soluble organic solvent, water, and a water-soluble polyvalent alcohol. In particular, the pigment dispersion composition preferably contains a polyvalent alcohol having a solubility of 0.1 g or greater in 100 g of water at 25° C. Examples of such polyvalent alcohols include diols such as ethanediol, propanediol, hexanediol; polymers of diethylene glycol, triethylene glycol and the like, and derivatives thereof resulting from partial alkyl-esterification or etherification; triols such as glycerin, butanetriol and hexanetriol, and derivatives thereof resulting from partial alkyl-esterification or partial alkyl-etherification; and polyols such as erythritol, pentaerythritol, arabitol, sorbitol and mannitol, their partially etherified products such as mannitan and sorbitan, and derivatives thereof resulting from partial alkyl-esterification or etherification.

The present invention further provides a pigment dispersion composition for fill-in coloration of an aluminum or aluminum alloy oxide film, essentially consisting of a pigment, a pigment dispersant, a water-soluble organic solvent, water, and at least one compound selected from the group consisting of water-soluble urea, thiourea and derivatives thereof. Preferably, these compounds also have a solubility of 0.1 g or greater in 100 g of water at 25° C. Examples thereof include urea, thiourea, and urea adducts and thiourea adducts having mono-, di-, tri- and tetraalkyl and mono-, di-, tri- and tetraalkanol added thereto at the N- and/or N'-positions thereof. Also preferred are those compounds cyclized by a nitrogen adduct such as N,N'-dimethylethyleneurea and N,N'-dimethylpropyleneurea. The alkyl groups of the derivatives may have an aromatic or aliphatic functional group. The alkanol groups of the derivatives may be esterified or etherified. Compounds having a plurality of urea skeletons in a molecule thereof, such as barbital, can be used. Compounds having a plurality of thiourea skeletons resulting from replacement of oxygen in the urea skeleton with sulfur can also be used. Such compounds need not necessarily be cyclic. A functional group such as mentioned above may be added to nitrogen of these compounds.

Where any of the water-insoluble amines and/or derivatives thereof is used, it is preferred to employ a resin acid as the pigment dispersant so that the amine or derivative thereof acts as a neutralizer for the resin acid. Such a resin acid preferably comprises a polymer having a carboxyl group in a molecular chain thereof such as an acrylic acid-styrene copolymer. Such a resin, per se, may be insoluble in water but becomes water-soluble by neutralization using a base in an amount equivalent to, or less or greater than the acid value of the resin. The use of, for example, triethylamine as the basic component for rendering the resin acid water-soluble will enable triethylamine which, per se, is immiscible with water, to be homogeneously introduced in water.

In this case, the coexistence of 1 to 20 wt % of a water-soluble organic solvent such as ethylene glycol or propylene glycol is more advantageous because the solvent allows the water-insoluble component in excess of an amount required for neutralization to be homogeneously dissolved in water.

The aforesaid compound is used preferably in an amount of 0.05 to 40 wt %. If the amount thereof is less than 0.05 wt %, the effect on the cleanability is as poor as when the compound is not added to the composition. On the other hand, if it is greater than 40 wt %, the pH value and electrical conductivity of the resulting composition are undesirably high. As a result, uneven coloration may occur during the electrophoretic coloring process, and the number of allowable times of repetitive coloration may decrease. In addition, an increase in the viscosity or a deterioration in the dispersion stability is likely to take place conceivably because the dispersibility of the pigment is adversely affected.

Thus, the pigment dispersion composition for fill-in coloration of an aluminum or aluminum alloy oxide film according to the present invention desirably contains at least one compound selected from the group consisting of the aforementioned water-soluble amines and/or derivatives thereof, water-insoluble amines and/or derivatives thereof, water-soluble polyvalent alcohols, and water-soluble urea and thiourea and derivatives thereof in an amount of 0.05 to 40 wt %.

Although the type and amount of the pigment dispersant is not particularly limited, it is possible to use any of so-called pigment dispersants including various surface active agents, polymeric dispersants, water-soluble resins and the like. Examples thereof include anionic or nonionic surface active agents, acrylic acid-styrene copolymers, styrene-maleic acid copolymers, styrene-sulfonic acid copolymers, and water-soluble sizing agents such as dextrin, starch and gum arabic.

Although pigments usable in the invention are not particularly limited to inorganic or organic pigments, carbon black or the like, it is preferable to use an organic pigment which has a smaller specific gravity and a vivid color, when sedimentation of the pigment in a coloring bath and vividness of the resulting color are taken into consideration. Among organic pigments, though various azo pigments are usable, phthalocyanine pigments, anthraquinone pigments, perylene pigments, perinone pigments, quinacridone pigments, diketopyrrolopyrrole pigments, dioxazine pigments, isoindolinon pigments and the like are particularly preferred in view of their light resistance.

The particle diameter of the pigment is not particularly limited because, by virtue of enhanced cleanability after coloration, it is possible to fill the pigment into micropores of an aluminum alloy oxide film by repetitive coloring and cleaning process. However, as previously described, 50%-cumulative point of the pigment particle diameter distribution in the pigment dispersion is desirably smaller than 50 nm for fill-in coloration of an aluminum alloy oxide film having micropores of smaller than 50 nm diameter. If the particle diameter at the 50%-cumulative point is greater than 50 nm, the repetitive coloration property may be deteriorated and the proportion of the pigment particles used for the filling may be reduced. If the micropore diameter of an aluminum alloy oxide film is about 50 nm to about 200 nm, a particle diameter of 200 nm or smaller at 50%-cumulative point of the pigment diameter distribution in the pigment dispersion will achieve advantageous fill-in coloration.

A method for coloring an anodic oxide film with a pigment by using phosphoric acid is disclosed in Japanese Examined Patent Publications No. SHO51-35177 and No. SHO52-5010. To obtain a film having micropores of diameters of 50 nm or greater, there are known a high-voltage anodizing process in a phosphoric acid bath as reported in Proceeding of Royal Society, London Series A.317, P.511 (1970), and a conventional process for enlarging the micropore diameter in a solution of a corrosive acid such as phosphoric acid after a typical anodizing process. Even if a film having a micropore diameter of 50 nm or greater can be obtained by such a process, the aluminum material, as a whole, may have a reduced strength. However, according to "Rigid Film Formation Method" as described in Aluminum Surface Technique Handbook, P.154 (Keikinzoku Shuppan 1980), anodizing in an aqueous solution of a mixture of an organic (dibasic) acid such as oxalic acid and a mineral acid provides films of a higher strength. A method utilizing such techniques is disclosed in Japanese Unexamined Patent Publication No. HEI5-93296.

However, even if a film having a micropore diameter of 250 nm or greater is obtained by the aforesaid method, the strength of the aluminum material itself is lowered, resulting in limited applications.

Before an aluminum or aluminum alloy oxide film is colored by filling micropores thereof with the pigment dispersion composition by electrophoresis, electric current application to the aluminum material is preferably performed with the aluminum material used as an anode in an anionic solution. Accordingly, the pigment dispersant is preferably adapted to render the pigment dispersion anionic. Particularly preferable as the pigment dispersant are polymers of αβ-ethylene monomers such as acrylic acid-styrene copolymers as mentioned above.

In the present invention, the pigment is dispersed in the following manner. First, the pigment is added to an aqueous resin solution to give a homogeneous suspension, and then the suspension is sufficiently dispersed by means of a dispersing machine such as roll mill, ball mill or sand mill. The dispersing time should be sufficiently long if the amount of the resin relative to the amount of the pigment is large enough. If the amount of the resin is not sufficient, a longer dispersing time causes agglomeration of pigment. After the dispersing process, the resulting dispersion is diluted to a desired pigment concentration, and coarse particles are removed therefrom by way of Sharples centrifugation and filtration. In this case, a lower dispersion viscosity provides a high classifying efficiency. If a desired particle size is not achieved by the first particle classification process, the classification process should be performed plural times.

The pigment concentration of the dispersion is suitably 0.05 to 50 wt %, preferably 0.1 to 20 wt % to achieve the pigment dispersing process advantageously. Such a dispersion can be used for fill-in coloration as it is or after having been diluted into an aqueous solution. If the proportion of the aforementioned compound in the pigment dispersion base is substantially decreased by the dilution, the compound in an additional amount should be mixed with diluting water for addition thereof to the pigment dispersion base. In the case of the water-insoluble compound such as triethylamine, it can be introduced into water in the form of a resin solution as described above. An excessive amount of the pigment makes the color density control difficult, and causes uneven coloration due to the deposition of the pigment on the film surface other than in the micropores.

Coloration is achieved by filling the micropores of the aluminum or aluminum alloy oxide film with any of the aforementioned pigment dispersion compositions (which may be used either alone or in combination of same or different types thereof) by electrophoresis a single time or plural times, and removing pigment deposited on the film surface other than in the micropores by immersion in still water or running water.

As long as pigment dispersions are within the scope of the invention, it is possible to use a single pigment dispersion containing different kinds of pigment or a mixture of two or more types of pigment dispersions which respectively contain a single kind of pigment or each contain different kinds of pigments.

The pigment dispersion composition for fill-in coloration of an aluminum or aluminum alloy oxide film according to the present invention essentially consists of a pigment, a pigment dispersant, a water-soluble organic solvent, water, and at least one compound selected from the group consisting of water-soluble or predetermined water-insoluble amines and/or derivatives thereof, water-soluble polyvalent alcohols, and water-soluble urea and thiourea and derivatives thereof. These compounds act to reduce the drying speed of water contained in the composition and, even after the composition is dried, intervene between pigment particles or between the pigment particles and the aluminum surface, so that pigment deposited on the surface other than in micropores of the aluminum film can be washed away by simple immersion in still water or running water.

Thus, unlike conventional compositions, there is no need to carry out brushing or showering to remove pigment deposited on the surface other than in the micropores by electrophoresis for the filling of pigment. Therefore, the cleaning process is simplified and operational inconveniences are eliminated.

The pigment dispersion composition for fill-in coloration which contains the aforesaid compounds enables the pigment particles to be filled in the micropores of the aluminum or aluminum alloy oxide film to a great depth, thereby providing a vivid color film of excellent weatherability and fastness and allowing repetitive coloration.

Consequently, an aluminum or aluminum alloy material with a vivid color film of excellent weatherability and fastness can be provided by filling micropores of an oxide film on the aluminum or aluminum alloy material with the pigment dispersion composition by electrophoresis. Also, it is possible to provide a surface coating on the aluminum or aluminum alloy material.

BEST MODE FOR CARRYING OUT INVENTION

Industrial-grade pure aluminum plates (JIS A1050P-H24, size=50 mm×20 mm) were each pretreated according to an ordinary method and then anodized in the following manner for formation of an oxide film thereon.

First, the plate was subjected to constant voltage electrolysis at DC 150V in a 0.3% oxalic acid bath at 20° C. for 6 minutes for formation of a 10 μm-thick anodic oxide film having a micropore diameter of 30 nm. The plate with the anodic oxide film was immersed in a 5% phosphoric acid bath for 100 minutes for enlarging the micropore diameter to 160 nm.

Pigment dispersions were prepared in the following manner.

JOHNCRYL 679 (tradename, an acrylic acid-styrene copolymer having an acid value of 200) available from Johnson Polymer Co. was neutralized and dissolved in water with a basic compound in an amount 1.1 times the equivalent of the acid value of the polymer to give aqueous solutions of 20 wt % resin.

The aqueous resin solutions prepared with the use of sodium hydroxide as the basic compound (157 mg per 1 g resin) is represented by "A", with the use of triethylamine (398 mg per 1 g resin) by "B", and with the use of triethanolamine (586 mg per 1 g resin) by "C".

Compositions shown in Table 1 were each stirred by a dissolver for 60 minutes to give a slurry, which was in turn added to 2.4 liters of glass beads. The resultant in a total amount of 3 liters was stirred for 30 minutes. The dispersant obtained after the glass beads were separated was subjected to Sharples centrifugation, and then used for electrophoretic coloration. It should be noted that the amount of each ingredient was represented in units of wt % in Table 1.

TABLE 1

| | Example | | | | | | | Com. Ex. | |
|---|---|---|---|---|---|---|---|---|---|
| Composition | 1 | 2[7] | 3[5] | 4 | 5 | 6 | 7[6] | 1 | 2 |
| Fastogen Blue-TGR[1] | 2 | 2 | 2 | 2 | | | | 2 | 15 |
| FastogenSuperMagentaRH[2] | | | | | 1 | | | | |
| Printex 90[3] | | | | | | 10 | | | |
| Nanotite[4] | | | | | | | 20 | | |
| Resin solution A | 4 | | | | | | | 4 | |
| Resin solution B | | 1.3 | 4 | | 10 | 20 | | | 10 |
| Resin solution C | | | | | | | | | |
| Triethylamine | | | | | 5 | | | | 2 |
| Triethanolamine | | | | 10 | | | | | 2 |
| Urea | | | | | | 10 | | | 2 |
| Propylene glycol | 10 | | | | 20 | | | | 20 |
| Glycerin | | | | | | | | | 14 |
| Ion exchange water | 84 | 96.7 | 94 | 94 | 64 | 60 | 50 | 94 | 35 |

Ingredients with notations 1 to 4 in Table 1 are all tradenames of the following particulars:

1. A phthalocyanine compound (C. I. Pigment Blue 15:3) produced by Dainippon Ink and Chemicals, Inc.;
2. A quinacridone compound (C. I. Pigment Red 122) produced by Dainippon Ink and Chemicals, Inc.;
3. Carbon black (C. I. Pigment Black 7) produced by DEGUSSA AG.; and
4. Transparent ultrafine iron oxide produced by Showa Denko K.K.

Particulars of ingredients with notations 5 to 7 are as follows:

5. The amount of triethylamine was 0.3 wt. % in Example 3;
6. The amount of residue after Sharples centrifugation was considerably large; and
7. The amount of triethylamine was 0.1 wt. % in Example 2.

By using the aluminum material treated in the aforesaid manner as an anode and a carbon electrode as a cathode, electrophoretic coloration was performed in each of the dispersions of Examples 1 to 7 and Comparative Example 1 shown in Table 1 with a voltage increase rate of DC 1V/second for 100 seconds.

The aluminum plate thus colored was immersed in water stirred by Labostirrer for two minutes for the washing thereof. One minute after, the surface of the aluminum plate was rubbed with a white paper sheet for evaluation of the cleanability on the basis of the degree of stain.

The dispersion of Comparative Example 2 had a high viscosity and a large pigment particle diameter and, hence, was considered to have dispersion failure. Therefore, a coloration test using Comparative Example 2 was not carried out.

Physical properties and cleanability of the dispersions are shown in Table 2.

TABLE 2

| | Example | | | | | | | Comp. Ex. | |
|---|---|---|---|---|---|---|---|---|---|
| Evaluation Items | 1 | 2 | 3 | 4 | 5 | 6 | 7 | 1 | 2 |
| Particle diameter of dispersant [nm] | 80 | 100 | 80 | 80 | 110 | 70 | 90 | 80 | 350 |
| Viscosity of dispersant [mp.sec] | 5 | 4 | 5 | 10 | 15 | 17 | 8 | 5 | 106 |
| Colorafter coloration | B | B | B | B | BR | BK | BW | B | — |
| Cleanability [1] | III | II | III | IV | IV | IV | IV | I | — |

B: Blue, BR: Bluish red, BK: Black, BW: Brown

In Table 2, notation 1 indicates the following evaluation criteria:

I: White paper sheet conspicuously stained;

II: Improved cleanability in comparison with the rating "I", though white paper sheet is stained;

III: White paper sheet stained a little; and

IV: White paper sheet hardly stained.

As seen from Table 2, the pigment dispersion compositions respectively employing an amine, a polyvalent alcohol and urea exhibited an improvement in cleanability. The pigment dispersion compositions of Examples 4 to 7, in particular, exhibited an excellent cleanability. It was also found that an optimal total amount of these compounds in a pigment dispersion composition is generally in the range between 0.05 and 40 wt %, preferably between 0.1 and 40 wt %.

The water-soluble amines shown in Table 1 each have a solubility of 1 g or greater in 100 g of water at 25° C., and the water-soluble polyvalent alcohols and urea shown in Table 1 each have a solubility of 0.1 g or greater in 100 g of water at 25° C. Water-soluble amines having a solubility of not greater than 1 g and water-soluble polyvalent alcohol and urea each having a solubility of not greater than 0.1 g all resulted in dispersions exhibiting a cleanability rated at "I".

It should be noted that, where pyridine (pKa at 25° C.=5.42) or nitroaniline (pKa at 25° C.=4.65) was used, the dispersibility of the pigment was very poor because the resin was not dissolved due to a too weak alkalinity of such compounds. Where guanidine having a pKa value of greater than 12 at 25° C. was used, coloring failure occurred and the aluminum plate was corroded because the resulting dispersion exhibited a too strong alkalinity. In contrast, Examples where triethylamine (pKa at 25° C.=10.7) and triethanolamine (pKa at 25° C.=7.76) were respectively used did not suffer from such disadvantages. It was found that a preferable pKa range at 25° C. was between 7.5 and 11. According to measurement to determine an allowable pKa range at 25° C., it was confirmed that the allowable range was between 7.1 and 12.

In Examples according to the present invention, uneven coloration was not observed after cleaning, and pigment particles were filled in the micropores of the aluminum film to a great depth, whereby a vivid color film of excellent weatherability and fastness was formed. Where the coloration process was repeatedly performed after cleaning until unevenly colored state occurred, any of Examples according to the present invention did not cause uneven coloration even when the coloration process was repeated 100 or more times. Therefore, the pigment dispersion compositions according to the present invention were found to have good repetitive coloration properties.

Industrial Applicability

As has been described, pigment dispersion compositions for fill-in coloration of an aluminum or aluminum alloy oxide film according to the present invention are effective in color coating of various industrial materials. Since these compositions eliminate conventionally needed brushing or showering for removing pigment deposited on the surface other than in micropores of the film, they are particularly advantageous in the coating of large-size aluminum materials.

Further, since the pigment dispersion compositions according to the present invention provide for a vivid color film having excellent weatherability and fastness and enable repetitive coloration, the compositions are suitable for the color coating of building materials, outdoor components of air conditioning equipments and the like which are installed outdoor.

What is claimed is:

1. A pigment dispersion composition filling micropores of an aluminum or aluminum alloy oxide film with a pigment for coloration thereof, the pigment dispersion composition comprising at least a pigment, a pigment dispersant, a water-soluble organic solvent, water, and a water-soluble amine or a derivative thereof, and being filled in said micropores.

2. A pigment dispersion composition filling micropores of an aluminum or aluminum alloy oxide film with a pigment for coloration thereof, as set forth in claim 1, wherein the water-soluble amine or derivative thereof have a solubility of 1 g or greater in 100 g of water at 25° C.

3. A pigment dispersion composition filling micropores of an aluminum or aluminum alloy oxide film with a pigment for coloration thereof, the pigment dispersion composition comprising at least a pigment, a pigment dispersant containing a resin acid, a water-soluble organic solvent, water, and a water-insoluble amine or a derivative thereof having a pKa value ranging from 7.1 to 12, the pKa value being defined as the logarithm of the reciprocal of the acid dissociation constant of a conjugated acid from the resin acid at 25° C., and being filled in said micropores.

4. A pigment dispersion composition filling micropores of an aluminum or aluminum alloy oxide film with a pigment for coloration thereof, the pigment dispersion composition comprising at least a pigment, a pigment dispersant, a water-soluble organic solvent, water, and a water-soluble polyvalent alcohol, and being filled in said micropores.

5. A pigment dispersion composition filling micropores of an aluminum or aluminum alloy oxide film with a pigment for coloration thereof, as set forth in claim 4, wherein the polyvalent alcohol has a solubility of 0.1 g or greater in 100 g of water at 25° C.

6. A pigment dispersion composition filling micropores of an aluminum or aluminum alloy oxide film with a pigment for coloration thereof, the pigment dispersion composition comprising at least a pigment, a pigment dispersant, a water-soluble organic solvent, water, and at least one compound selected from the group consisting of water-soluble urea, thiourea and derivatives thereof, and being filled in said micropores.

7. A pigment dispersion composition filling micropores of an aluminum or aluminum alloy oxide film with a pigment for coloration thereof, as set forth in claim 6, wherein at least one compound selected from the group consisting of water-soluble urea, thiourea and derivatives thereof has a solubility of 0.1 g or greater in 100 g of water at 25° C.

8. A pigment dispersion composition filling micropores of an aluminum or aluminum alloy oxide film with a pigment for coloration thereof, the pigment dispersion composition comprising at least a pigment, a pigment dispersant containing a resin acid, a water-soluble organic solvent, water, a water-soluble polyvalent alcohol, at least one compound selected from the group consisting of a water-soluble amine or a derivative thereof, at least one compound selected from the group consisting of a water-insoluble amine or a derivative thereof which has a pKa value ranging from 7.1 to 12, the pKa value being defined as the logarithm of the reciprocal of the acid dissociation constant of a conjugated acid from the resin acid at 25° C., and at least one compound selected from the group consisting of water-soluble urea, thiourea or derivatives thereof, the total amount of said at least one compound selected from the group consisting of a water-soluble amine or a derivative thereof being from 0.05 to 40 wt % of the composition, and being filled in said micropores.

9. A pigment dispersion composition filling micropores of an aluminum or aluminum alloy oxide film with a pigment for coloration thereof, as set forth in any of claims 1 to 8 wherein the pigment has a 50%-cumulative point (average particle diameter: D50) of a pigment particle diameter distribution of 200 nm or smaller.

10. A pigment dispersion composition filling micropores of an aluminum or aluminum alloy oxide film with a pigment for coloration thereof, as set forth in any of claims 1 to 8 wherein the concentration of the pigment is from 0.05 to 20 wt % of the composition when the composition is used for coloration of an aluminum film.

11. A pigment dispersion composition filling micropores of an aluminum or aluminum alloy oxide film with a pigment for coloration thereof, as set forth in any of claims 1 to 8, wherein the pigment comprises one or more kinds of pigments.

12. A method for fill-in coloration, comprising the steps of:

filling micropores of an aluminum or aluminum alloy oxide film with any one of the pigment dispersion compositions as defined by claims 1 to 8 by way of electrophoresis a single time or a plurality of times for coloration of the oxide film, the pigment dispersion compositions in the electrophoresis in the plurality of times being either the same or different composition, and immersing the filled aluminum alloy oxide film in still water or running water to remove pigment deposited on a film surface other than in the micropores.

13. An aluminum or aluminum alloy material comprising an aluminum or aluminum oxide film colored by filling micropores of the oxide film with any one of the pigment dispersion compositions as defined by claims 1 to 8 by electrophoresis.

14. An aluminum or aluminum alloy material as set forth in claim 13, further comprising a surface coating provided thereon.

15. A pigment dispersion composition, consisting essentially of at least a pigment, a pigment dispersant, a water-soluble organic solvent, water, and a water-soluble amine or a derivative thereof, in amounts effective to deposit said pigment in micropores of an aluminum or aluminum alloy oxide film while allowing removal of pigment from a surface of the oxide film other than the micropores by immersing in or rinsing with water.

16. A pigment dispersion composition for filling-in micropores of an aluminum or aluminum alloy oxide film with a pigment for coloration thereof, consisting essentially of at least a pigment, a pigment dispersant, a water-soluble organic solvent, water, and a water-soluble amine or a derivative thereof.

17. A pigment dispersion composition for filling-in micropores of an aluminum or aluminum alloy oxide film with a pigment for coloration thereof, as set forth in claim 16, wherein the water-soluble amine or derivative thereof have a solubility of 1 g or greater in 100 g of water at 25° C.

18. A pigment dispersion composition for filling-in micropores of an aluminum or aluminum alloy oxide film with a pigment for coloration thereof, as set forth in claim 16, wherein the pigment has a 50%-cumulative point (average particle diameter: D50) of a pigment particle diameter distribution of 200 nm or smaller.

19. A pigment dispersion composition for filling-in micropores of an aluminum or aluminum alloy oxide film with a pigment for coloration thereof, as set for in claim 16 wherein the concentration of the pigment is from 0.05 to 20 wt % of the composition when the composition is used for coloration of an aluminum film.

20. A pigment dispersion composition for filling-in micropores of an aluminum or aluminum alloy oxide film with a pigment for coloration thereof, as set forth in claim 16, wherein the pigment comprises one or more kinds of pigments.

21. A pigment dispersion composition for filling-in micropores of an aluminum or aluminum alloy oxide film with a pigment for coloration thereof, consisting essentially of at least a pigment, a pigment dispersant containing a resin acid, a water-soluble organic solvent, water, and a water-insoluble organic amine or a derivative thereof having a pKa value ranging from 7.1 to 12, the pKa value being defined as the logarithm of the reciprocal of the acid dissociation constant of a conjugated acid from the resin acid at 25° C.

22. A pigment dispersion composition for filling-in micropores of an aluminum or aluminum alloy oxide film with a pigment for coloration thereof, consisting essentially of at least a pigment, a pigment dispersant, a water-soluble organic solvent, water, and a water-soluble polyvalent alcohol.

23. A pigment dispersion composition for filling-in micropores of an aluminum or aluminum alloy oxide film with a pigment for coloration thereof, as set forth in claim 22, wherein the polyvalent alcohol has a solubility of 0.1 g or greater in 100 g of water at 25° C.

24. A pigment dispersion composition for filling-in micropores of an aluminum or aluminum alloy oxide film with a pigment for coloration thereof, consisting essentially of at least a pigment, a pigment dispersant, a water-soluble organic solvent, water, and at least one compound selected from the group consisting of water-soluble urea, thiourea and derivatives thereof.

25. A pigment dispersion composition for filling-in micropores of an aluminum or aluminum alloy oxide film with a pigment for coloration thereof, as set forth in claim 24, wherein at least one compound selected from the group consisting of water-soluble urea, thiourea and derivatives thereof has a solubility of 0.1 g or greater in 100 g of water at 25° C.

26. A pigment dispersion composition for filling-in micropores of an aluminum or aluminum alloy oxide film with a pigment for coloration thereof, consisting essentially of at least a pigment, a pigment dispersant, a water-soluble organic solvent, water, a water-soluble polyvalent alcohol, at least one compound selected from the group consisting of a water-soluble amine or a derivative thereof, at least one compound selected from the group consisting of a water-insoluble amine or a derivative thereof which has a pKa value ranging from 7.1 to 12, the pKa value being defined as the logarithm of the reciprocal of the acid dissociation constant of a conjugated acid from the resin acid at 25° C., and at least one compound selected from the group consisting of water-soluble urea, thiourea or derivatives thereof, the total amount of said at least one compound selected from the group consisting of a water-soluble amine or a derivative thereof being from 0.05 to 40 wt % of the composition.

27. A method of filling the micropores of an aluminum or aluminum alloy oxide film with a pigment by electrophoresis using a pigment dispersion comprising at least a pigment, a pigment dispersant, a water-soluble organic solvent and water, and further including a water-soluble amine or derivative thereof.

28. A method of filling the micropores of an aluminum or an aluminum alloy oxide film with a pigment by electrophoresis using a pigment dispersion comprising at least a pigment, a pigment dispersant containing a resin acid, a water-soluble organic solvent and water, and further including a water-insoluble organic amine or derivative thereof having pKa value from 7.1 to 12, the pKa value being defined as the logarithm of the reciprocal of the acid dissociation constant of a conjugated acid from the resin acid at 25° C.

29. A method of filling the micropores of an aluminum or aluminum alloy oxide film with a pigment by electrophoresis using a pigment dispersion comprising at least pigment, a pigment dispersant, a water-soluble organic solvent and water, and further including a water-soluble polyvalent alcohol.

30. A method of filling the micropores of an aluminum or aluminum alloy oxide film with a pigment by electrophoresis using a pigment dispersion comprising at least a pigment, a pigment dispersant, a water-soluble organic solvent and water, and further including at least one compound selected from the group consisting of water-soluble urea, thiourea and derivatives thereof.

* * * * *